United States Patent [19]

Lace

[11] 4,030,466

[45] June 21, 1977

[54] SYNCHRONOUS ROTOR INDEXING MECHANISM

[75] Inventor: Melvin Arthur Lace, Prospect Heights, Ill.

[73] Assignee: Motorola, Inc., Schaumburg, Ill.

[22] Filed: Dec. 31, 1974

[21] Appl. No.: 537,748

[52] U.S. Cl. ..... 123/146.5 A; 64/25; 200/19 DR; 200/29; 200/80 R

[51] Int. Cl.[2] ..... F22B 7/06

[58] Field of Search ..... 64/25, 24; 200/19 DR, 200/25, 29, 80 R; 123/146.5 A

[56] References Cited

UNITED STATES PATENTS

| | | | |
|---|---|---|---|
| 1,447,745 | 3/1923 | Atkinson | 200/25 |
| 1,495,397 | 5/1924 | Brewer | 200/25 |
| 1,674,152 | 6/1928 | Andrew | 200/25 |
| 2,433,888 | 1/1948 | Brownlee | 200/25 |
| 2,657,035 | 10/1953 | Hartman, Jr. | 200/29 |

*Primary Examiner*—Samuel Scott
*Assistant Examiner*—Randall Heald
*Attorney, Agent, or Firm*—Donald J. Lisa; Margaret Marsh Parker; James W. Gillman

[57] ABSTRACT

A rotor for the high voltage distribution system of an internal combustion engine, the contact member of the rotor being movable relative to the rotor shaft for a desired advance-retard characteristic. The rotor itself does not move relative to the rotor shaft. The device is for use with electronic ignition systems and one function is to replace the mechanical advance provided in conventional breaker point type distributors by the centrifugal weights which rotate the entire cam and rotor assembly. A range of characteristics responsive to engine velocity and/or acceleration is provided for within the basic design.

1 Claim, 9 Drawing Figures

FIG. 1
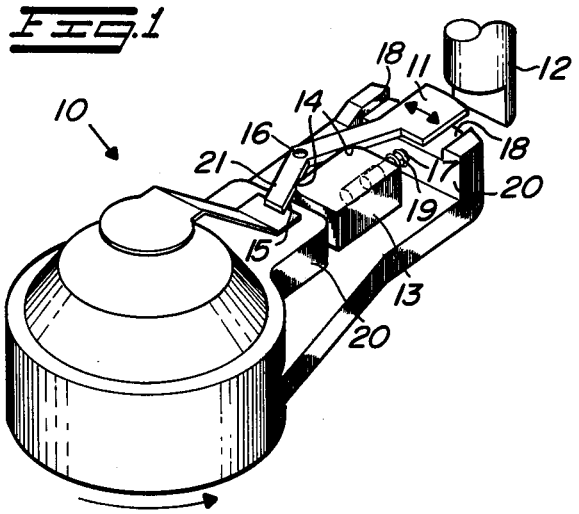
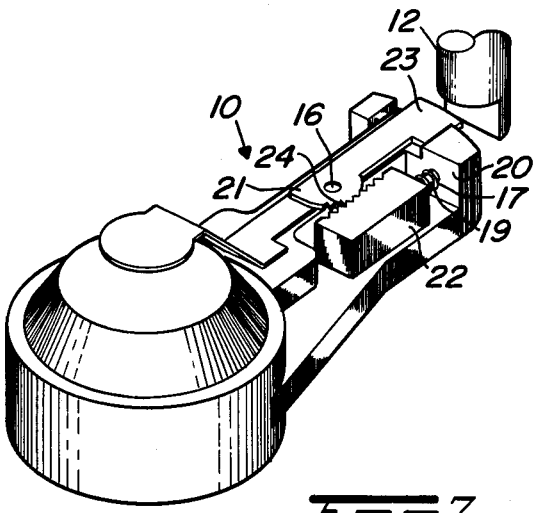
FIG. 2
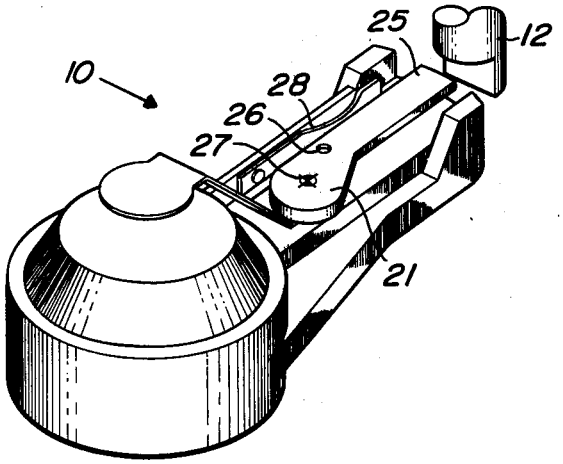
FIG. 3
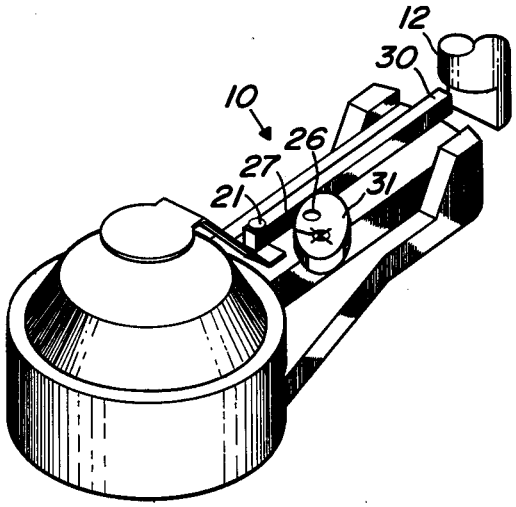
FIG. 4
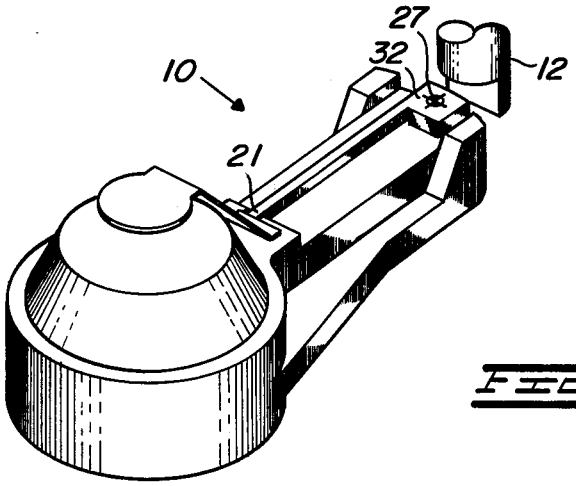
FIG. 5

SYNCHRONOUS ROTOR INDEXING MECHANISM

BACKGROUND OF THE INVENTION

1. Field of the Invention

The present invention relates to ignition systems for internal combustion engines and more particularly to indexing the high voltage distribution system for electronic ignition systems.

2. Prior Art

Indexing the high voltage contact requires only that the rotor contact of the distributor be in the approximate vicinity of the terminal leading to the appropriate spark plug at the proper time for firing. Vacuum advance and mechanical advance of the whole cam and rotor assembly were generally satisfactory for this function in the ignition systems of the past. However, with the advent of electronic ignition systems it became desirable to have indexing of the high voltage which could be synchronized with the electromagnetically produced pulses without dependence on the conventional advance mechanisms of the past. At high speeds, without adjustable indexing, the spark could be discharged before the rotor contact had reached the minimum separation from the terminal, thus wasting a portion of the energy of the spark. At even higher speeds it could discharge to the prior terminal.

Prior art attempting to solve this problem include Minks U.S. Pat. No. 3,705,501, which discloses a device using advance derived from the throttle of the automobile; Atkinson, U.S. Pat. No. 1,447,745, which includes contacts movable on a rotor by centrifugal force and fixed arcuate contacts on a nonrotating plate, the fixed contacts leading to the posts leading to the spark plug wiring; Hartman, U.S. Pat. No. 2,657,035, uses centrifugally activated weights to rotate one plate of the rotor with respect to another plate, to advance the rotor contact. The rotor contact is not movable relative to its mounting plate.

The present invention is an improvement over any of the prior art in simplicity, size and range of possible advance characteristics.

The Federal Environmental Protection Agency plans to require more retard during low speed acceleration than is presently used. This is to reduce engine pressure and knocking and thereby reduce air pollution. Also, the addition of other auxiliary engine components such as pollution control devices, air conditioning, etc., under the hood, make it desirable also to reduce the physical dimension of the distributor.

SUMMARY OF THE INVENTION

It is therefore a general object of the present invention to provide an indexing device for an internal combustion engine which will synchronize the position of the rotor with respect to a spark plug terminal at the proper time for firing.

It is a specific object to provide this indexing by moving the rotor contact relative to the mounting shaft while keeping the rotor itself fixed to the shaft.

It is a more specific object to provide this indexing within a small distributor housing.

It is another specific object to provide an indexing mechanismm with a variety of advance-retard characteristics to meet a variety of specific demands.

The present invention achieves these objectives by eliminating the mechanical advance mechanisms previously used with breaker point ignition systems, and by providing for the appropriate advance and retard of the rotor contact in response to engine velocity and acceleration. This basic device can assume a variety of physical embodiments to achieve this variety of characteristics by combinations of responses to the forces of angular acceleration and of angular velocity as expressed in centrifugal force and air resistance.

BRIEF DESCRIPTION OF THE DRAWINGS

FIGS. 1 and 2 are perspective views of embodiments responsive to centrifugal force only.

FIGS. 3, 4, 5, 6, 7, 8 and 9 are perspective views of other embodiments responsive to both angular acceleration and centrifugal force.

DESCRIPTION OF PREFERRED EMBODIMENTS

Figure 6:
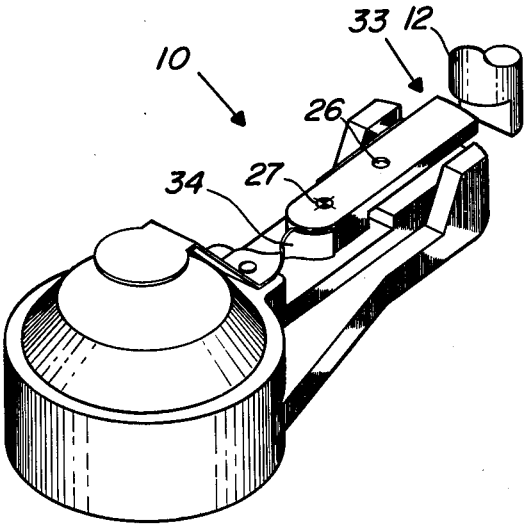

Referring now to FIG. 1, on a portion of an insulating rotor 10 of a distributor (not shown) is mounted a movable contact 11 which can be advanced or retarded, relative to a terminal 12, as indicated. The rotor 10 and its shaft rotate counterclockwise in FIGS. 1–9 when the engine is running. The terminal 12 is a contact inside the housing (not shown) of the distributor which connects to a particular spark plug (not shown). Centrifugal force acting on a weight 13, movably mounted on a shaft 19, causes the weight to be moved toward the perimeter of the rotor 10. Two of the corners 14 of the weight 13 press against a side surface 15 of the contact 11. The contact is pivoted at a pivot point 16, thus, as weight 13 moves outwardly along the shaft 19, the outward end of the contact is caused to advance relative to the rotor and rotor shaft. A spring 17 opposes the outward motion of the weight 13 and provides a restoring force for the weight and the contact. The shoulders 18 of the rotor are designed to limit the travel of the contact 11. Wall portions 20 of the rotor serve as stops for the weight 13 and as a base for the shaft 19 and spring 17. The high voltage connection is made by means of a sliding contact engaged with an innermost end 21 of contact 11.

As to overall operation, a higher velocity of the internal combustion engine (not shown) increases the centrifugal force acting on the weight 13, causing it to move toward the perimeter of the rotor 10. As it moves outwardly, it pushes on the contact 11 and causes the outer end of the contact to arrive at a point opposite the terminal 12 sooner than it would have at a lower speed. This is termed "advance."

FIG. 2 shows a similar embodiment with a weight 22 moving outwardly on the shaft 19 on the rotor 10 under centrifugal force and opposed by the spring 17. A contact 23 is caused to rotate around the pivot point 16 by a rack and pinion mechanism at a point 24. Thus an increased engine speed produces an advance in the position of the end of the contact 23 relative to the shaft (not shown) of rotor 10.

In FIG. 3, the rotor 10 supports a contact member 25 which pivots around a point 26 and has its center of gravity at a point 27. A return spring 28 provides a restoring force on the contact 25. In operation, at any given engine velocity, there will be a centrifugal force acting on the rotor contact. This force, being a radial force, will tend to cause the center of gravity 27 of the contact to move outwardly. Since the contact is pivoted at the point 26, the effect of the centrifugal force will be counterclockwise motion around the point 26. During any period of engine acceleration, an inertial force opposite to the acceleration force will tend to cause the center of gravity 27 to resist being accelerated, meaning that it will move in a rearward direction normal to the radius. Thus the end 25 of the rotor will be caused to move in the forward direction, producing additional advance during periods of acceleration. It should be noted that the advance due to acceleration can be minimized or even eliminated if desired by the amount of damping action of friction between the moving parts, such as between the contact 25 and the pin 26 and between the underside of the contact 25 and the upper surface of the rotor 10 on which the contact 25 is supported. Such friction forces also assist in preventing undue oscillation during shock and acceleration conditions.

It is clear that in FIGS. 1 and 2 the adjustment is provided by an axially movable, independent weight, whereas in FIG. 3 the weight is an eccentric but integral portion of the contact arm 25. In the embodiment shown in FIG. 4 a contact 30 is mounted near the point 21 where high voltage contact is made. That mounting may be a pin, a clamp or the equivalent which holds firmly the end 21. The contact 30 is a self-restoring resilient member. The weight in this embodiment is a cam 31 pivoted at a point 26 and having its center of gravity at a point 27. The side of the cam adjacent to the contact 30 is curved, the shape of the curve determining the response characteristic. Centrifugal force will tend to cause the center of gravity 27 to rotate about the pivot point 26, as will angular acceleration at low speed. The distance from the pivot point to any point on the curved side of cam 31 determines the displacement of the end of contact 30. Thus, in FIG. 4, the eccentric weight is not an integral part of the contact arm as was the case in FIG. 3. FIG. 4 combines the concepts of FIGS. 1, 2 and 3, i.e. an independent, eccentric, pivotable weight contacting a pivotable arm.

In FIG. 5 the contact member 32 combines the functions of electrical contact, weight, and restoring spring. The contact arm is fixedly mounted at its innermost end 21 to the rotor and has a rod portion connecting to a more massive portion at the outermost end. The center of gravity is angularly displaced from the rod portion. As engine velocity increases, centrifugal force will tend to advance the outermost end of contact 32 in a bending movement. However, during periods of angular acceleration, the outer end will tend to be retarded which is opposite to the manner in which FIGS. 3 and 4 operate.

FIG. 6 shows an embodiment wherein a contact 33 is also the operative weight. It is pivoted at the point 26 and the center of gravity is at the point 27. As the rotor 10 accelerates, the position of the contact 33 is advanced relative to the rotor shaft. A high voltage member 34 provides both electrical contact with contact 33 and its restoring force. There is minimal effect from centrifugal force in this embodiment.

Figure 7:
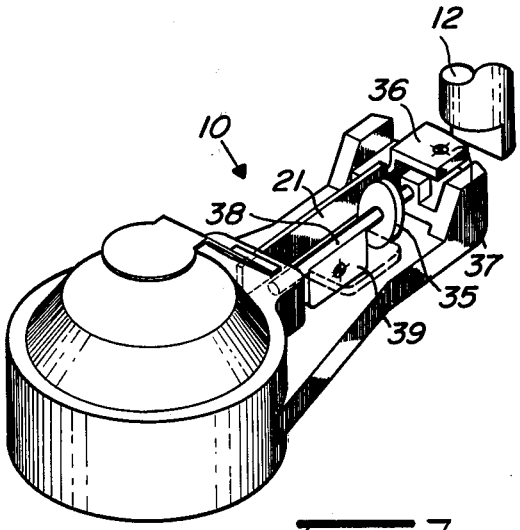

The embodiment of FIG. 7 is similar to FIG. 5, except that additional means are provided whereby the force of acceleration can cause either advance or retard depending on the design of a cam 35. In FIG. 7 is shown a self-restoring contact member 36 with its center of gravity 37. The contact 36 will, of itself, tend to advance slightly with increased velocity, but retard during periods of acceleration. A second member 38 is rotatable around its longitudinal axis. Under the force of acceleration an attached fin 39 tends to rotate to the dotted position. As it does, the cam 35 is rotated against the side of the contact 36, thereby causing the contact to move. The shape of the cam 35 determines its effect on the response characteristic of the contact 36.

Figure 8:
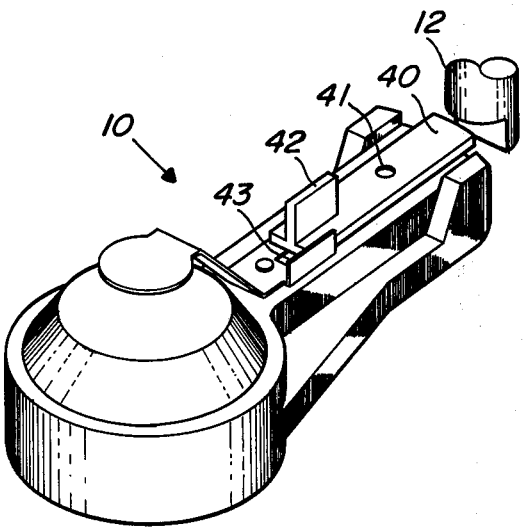

In FIG. 8 is shown an embodiment where a contact 40, pivoted at a point 41, is caused to move relative to the rotor shaft by the drag of an air vane 42. The added weight of the vane causes some acceleration advance. The high voltage contact 43 serves also as the restoring spring in this embodiment.

Figure 9:
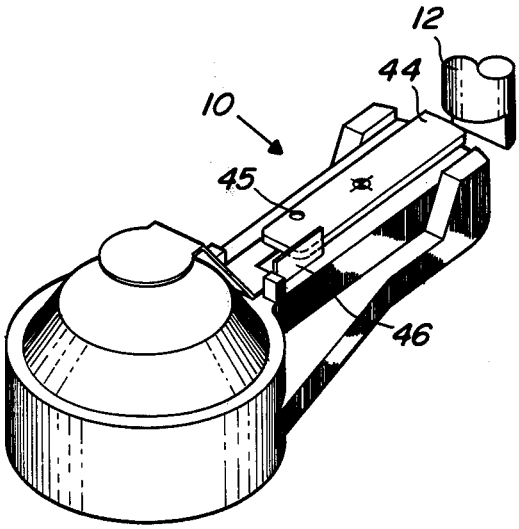

FIG. 9 shows a contact member 44 eccentrically mounted at and pivoted about a point 45. Increased engine speed will cause counterclockwise rotation of the contact member causing some advance of the outer end. However, during acceleration some retard will occur. A vertical portion 46 of the resilient high voltage contact 21 also provides restoring force.

It should be noted that sufficient damping is required in all of these embodiments to prevent undue oscillation under conditions of shock or extreme acceleration.

It should be further noted that the basic invention of advancing and retarding the contact of the rotor by means of centrifugal force and angular acceleration, while keeping the rotor in fixed position relative to the shaft, is not limited to the embodiments shown herein.

What is claimed is:

1. In a voltage distribution system of an internal combustion engine, the engine having spark plugs and a crankshaft, the distribution system having a housing, a device for synchronously indexing the distribution system, the device comprising:

a shaft rotatable in response to the rotation of the crankshaft of the combustion engine, an insulating element fixedly mounted on the shaft, contact means comprising a contact arm pivotably mounted on the insulating element for supplying high voltage pulses and having an outer end free, a multiplicity of terminal means for receiving the high voltage pulses, the terminal means being mounted in the housing of the distribution system and being connected to the spark plugs, a weight mounted on the insulating element for radial motion outward under centrifugal force and adapted to coact with a portion of the contact means, causing the contact means to advance relative to the insulating means, and wherein said contact portion and said weight comprise a rack-and-pinion mechanism for causing the contact arm to coact with the weight; and yielding means to oppose the outward motion of the weight, whereby the high voltage pulses are indexed to the proper terminal means at the firing time of time of the high voltage pulses for efficiently firing the combustible mixture in an engine cylinder.

* * * * *